United States Patent [19]

Furrer et al.

[11] Patent Number: 5,016,456

[45] Date of Patent: May 21, 1991

[54] PROCESS FOR MAKING HOLLOW BILLETS INTO TUBES

[75] Inventors: Hansjörg Furrer, Ziefen, Switzerland; Raimo Peltoniemi, Bay Village, Ohio; Norbert Richle, Remetschwill, Switzerland; Dietrich Ulrich, Nestlake, Ohio

[73] Assignee: Lonza Ltd., Gampel/Valais, Switzerland

[21] Appl. No.: 330,700

[22] Filed: Mar. 30, 1989

[30] Foreign Application Priority Data

Mar. 30, 1988 [CH] Switzerland ..... 01203/88

[51] Int. Cl.[5] ..... B21B 17/02; B21B 9/00; B21B 45/02; B21C 43/00

[52] U.S. Cl. ..... 72/38; 72/39; 72/45; 72/209

[58] Field of Search ..... 72/38, 43, 44, 45, 96, 72/97, 208, 209

[56] References Cited

U.S. PATENT DOCUMENTS

| | | | |
|---|---|---|---|
| 670,756 | 8/1901 | Kennedy et al. . | |
| 984,569 | 2/1911 | Koch | 72/209 |
| 998,762 | 7/1911 | Faller . | |
| 1,945,929 | 2/1934 | Bark | 72/38 |
| 2,017,389 | 10/1935 | Bark et al. | 72/38 |
| 2,176,879 | 10/1939 | Bartell | 44/9 |
| 2,588,625 | 3/1952 | Ferner et al. | 117/49 |
| 2,719,386 | 10/1955 | Johnson et al. | 49/82 |
| 2,735,814 | 2/1956 | Hodson, Sr. et al. | 252/30 |
| 3,198,735 | 8/1965 | Lamson et al. | 252/25 |
| 3,242,075 | 3/1966 | Hunter | 252/22 |
| 3,341,454 | 9/1967 | Chor, Jr. et al. | 252/22 |
| 3,344,065 | 9/1967 | Gansheimer | 252/18 |
| 3,384,580 | 5/1968 | Peace | 252/29 |
| 3,472,770 | 10/1979 | Preston et al. | 252/23 |
| 3,525,692 | 8/1970 | Dodson et al. | 252/29 |
| 3,577,754 | 5/1971 | Calmes | 72/45 |
| 3,770,634 | 11/1973 | Dodson et al. | 252/29 |
| 3,801,504 | 4/1974 | Stone | 252/23 |
| 3,833,502 | 9/1974 | Leary et al. | 252/49.5 |
| 3,838,048 | 9/1974 | Hedge | 252/12 |
| 3,908,038 | 9/1975 | Nienart et al. | 427/27 |
| 3,983,042 | 9/1976 | Jain et al. | 252/18 |
| 4,039,337 | 8/1977 | Brown et al. | 106/38.28 |

(List continued on next page.)

FOREIGN PATENT DOCUMENTS

| | | | |
|---|---|---|---|
| 295268 | 3/1966 | Australia . | |
| 0133937 | 7/1984 | European Pat. Off. . | |
| 2104041 | 8/1971 | Fed. Rep. of Germany . | |
| 2430249 | 6/1974 | Fed. Rep. of Germany . | |
| 2921620 | 12/1979 | Fed. Rep. of Germany . | |
| 58-116910 | 7/1983 | Japan | 72/45 |
| 59-18799 | 1/1984 | Japan . | |
| 61-137613 | 6/1986 | Japan | 72/45 |
| 596294 | 3/1978 | Switzerland . | |
| 609728 | 3/1979 | Switzerland . | |
| 981351 | 12/1982 | U.S.S.R. . | |
| 1030405 | 7/1983 | U.S.S.R. . | |
| 2036071 | 6/1980 | United Kingdom . | |
| 2135336 | 8/1984 | United Kingdom | 72/38 |
| 2163691 | 3/1986 | United Kingdom | 72/38 |

*Primary Examiner*—E. Michael Combs
*Attorney, Agent, or Firm*—Fisher, Christen & Sabol

[57] ABSTRACT

Hollow billet (13) in a first operation of a piercing mill (1, 2) is advanced over a piercer (10) placed on front end (5) of a piercer rod (6) and is retracted after removal of the piercer. During the advance of hollow billet (13) a lubricant is applied to the hollow billet inside wall processed immediately before by piercer (10) with the help of an inert carrier gas current through outlet openings (16, 17) on front part (14) of piercer rod (6). In this way the lubricant is distributed uniformly on the hollow billet wall in the first operation for processing in the second operation of the piercing mill and in the latter for processing in a third operation (in a reeling mill). Thus, no delay whatsoever occurs in the processing, i.e., the operations can be performed without interruption successively, and no environmental pollution by the agent occurs.

21 Claims, 1 Drawing Sheet

U.S. PATENT DOCUMENTS

| | | | |
|---|---|---|---|
| 4,050,932 | 9/1977 | Lemmer | 75/211 |
| 4,052,323 | 10/1977 | Feneberger et al. | 252/23 |
| 4,055,025 | 10/1977 | Seese et al. | 51/411 |
| 4,055,503 | 10/1977 | Anselment et al. | 252/12 |
| 4,090,666 | 5/1978 | Peck | 239/15 |
| 4,104,178 | 8/1978 | Jain et al. | 252/30 |
| 4,115,283 | 9/1978 | Needham | 252/12.4 |
| 4,140,834 | 2/1979 | Marcantonio et al. | 428/419 |
| 4,206,060 | 6/1980 | Yamamoto et al. | 252/22 |
| 4,206,061 | 6/1980 | Dodson et al. | 252/29 |
| 4,228,020 | 10/1980 | Papay | 252/29 |
| 4,314,907 | 2/1982 | Defretin et al. | 252/22 |
| 4,321,295 | 3/1982 | Smith-Johannsen | 428/206 |
| 4,357,249 | 11/1982 | Mellor | 252/12 |
| 4,452,169 | 6/1984 | Matsuda | 118/50 |
| 4,454,173 | 6/1984 | Koga | 427/235 |
| 4,470,939 | 9/1984 | Schoolcraft | 264/104 |
| 4,575,430 | 3/1986 | Periard et al. | 252/12.6 |
| 4,656,105 | 4/1987 | Kobayashi et al. | 429/192 |
| 4,668,534 | 6/1987 | Gray | 427/183 |
| 4,687,598 | 8/1987 | Varma | 252/518 |
| 4,702,860 | 10/1987 | Kinderov et al. | 252/511 |
| 4,790,263 | 12/1988 | Eckert et al. | 118/317 |

PROCESS FOR MAKING HOLLOW BILLETS INTO TUBES

BACKGROUND OF THE INVENTION

1. Field of the Invention

The invention relates to a process and a device for making hollow billets into tubes in several operations.

2. Background Art

A hollow billet, as is generally known, means the hollow cylindrical intermediate product in the production of tubes. For the production of the hollow billet, usually-rolled-round shaped steel or continuous casting is pierced by a mandrel in a rotary piercing mill. The hollow billet is then roughed down in a breaking-down rolling mill for further elongating and leveling of the wall thickness. The roughing down generally takes place in two operations, that is, so-called passes. In each of the two passes, the hollow billet is advanced over a piercer placed on the front end of a piercer rod by a pair of working rolls, after which the piercer is removed and the hollow billet is retracted by return rolls. In the second pass a piercer somewhat greater in size than the first is used. Then, the inside wall of the hollow billet is smoothed in a reeling mill.

Before the first pass a descaling agent, to which a lubricant is added, is applied in the hollow billet. This takes place, for example, by means of the device described in European Published Patent Application No. 250,881, which by means of a sliding unit is brought up to the hollow billet hollow space and centered, after which an air current, laden with the descaling agent, is conducted into the hollow billet hollow space by the device. After the amount of air, laden with the descaling agent, has flowed through the hollow space, the device is retracted by means of the sliding unit. After the end of the reaction time necessary for the descaling, the first pass then takes place.

Before the second pass, a lubricant powder or granulate is applied in each case in the hollow billet. Since the two passes are to be performed successively with as little interruption as possible (interrupted only by putting the second piercer on the piercer rod), only a short time remains for application of the lubricant. For this reason, in the prior art, it is thrown into the front end of the hollow billet by a worker by means of a shovel. The same also happens in the prior art before smoothing in the reeling mill: a worker throws a lubricant into the hollow billet by means of a shovel.

The known application of the lubricant is disadvantageous for several reasons. An operator is used for that purpose alone or the process is delayed if the operator responsible for putting on the piercer must also apply the lubricant. (In the usual process times the worker must reapply lubricant about every 10 seconds, so that practically no time remains for other work. Throwing in the lubricant result in a dust cloud polluting the environment, harmful to the operator's health. Lubrication is uneven and great amounts of lubricant are consumed, since throwing the lubricant results in an adhesion of the lubricant in the front, lower part of the hollow billet inside wall, while the upper, back areas of the hollow billet inside wall are not sufficiently or only insufficiently supplied with lubricant.

BROAD DESCRIPTION OF THE INVENTION

An object of the invention is to provide a remedy for the above-mentioned prior art problems. Another object of the invention is to provide a device and a process for applying a lubricant and/or descaling agent evenly on the hollow billet inside wall for the respective processing, namely, so that the processing is not delayed, i.e., the operation can be performed without interruption successively and, as much as possible, no environmental pollution occurs. The invention device and process achieves such objects.

The invention involves a process for making hollow billets into tubes in several operations. In the invention process a hollow billet, at least in a first operation, is advanced over a piercer placed on the front end of a piercer rod and is retracted after removal of the piercer. At least in the first operation, during the advance and/or return of the hollow billet, a lubricant and/or descaling agent is applied on the inside wall of the hollow billet.

Preferably, during the advance and/or return of the hollow billet, the lubricant and/or descaling agent is applied to the inside wall of the hollow billet already processed by piercer for its further processing in the next operation.

At least in a first operation, preferably an inert gas is directed inside of the hollow billet to prevent a scaling of the inside wall. Preferably, the lubricant and/or agent, by means of a carrier gas current, most preferably an inert gas current, on the front end or the part of the piercer rod connected to it, is directed on the inside wall of the hollow billet. The carrier gas current laden with lubricant and/or descaling agent preferably is advanced through the piercer rod and on one or more outlet openings placed on its front end or on the part connected to it is directed at the inside wall of the hollow billet. Preferably, the inert gas, especially nitrogen, used as the carrier gas for the lubricant and/or descaling agent, is directed, unladen, constantly through the piercer rod and the outlet openings to prevent both a scaling of the inside wall of the hollow billet and a penetration of cooling water into the outlet openings. A twist is preferably imparted to the carrier gas current, laden with the lubricant and/or descaling agent, from the outlet opening or openings. The carrier gas current laden with the lubricant and/or descaling agent is directed away from the piercer is preferably directed with a twist on the inside wall of the hollow billet.

Preferably the lubricant and/or descaling agent is applied to the inside wall of the hollow billet behind the piercer during each advance of the hollow billet. The lubricant and/or descaling agent during each return of the hollow billet is preferably applied to the inside wall of the hollow billet through the front or through the part of the piercer rod connected to it. Preferably, where the hollow billet in a second operation is advanced over a piercer of greater diameter placed on the front end of the piercer rod and in third operation is smoothed, both in the first and second operation, a lubricant and/or descaling agent is applied on the inside wall of the hollow billet processed by the piercer for the second or third operation.

The invention also involves a device for performing the invention process. The invention device includes a rolling mill, a piercer rod and a piercer that can be put on its front end. The piercer rod has a feed pipe for the lubricant and/or descaling agent and one or more outlet openings for the agent on its front end or on the part connected to it.

Preferably the feed pipe is placed coaxially in the piercer rod.

Preferably, the part of the piercer rod adjacent to the front end has several ducts, running from the axis of the piercer rod to the piercer rod jacket, connected to the feed pipe, and running in a curved manner, so that the carrier gas, laden with the lubricant and/or descaling agent, comes out through the ducts with a twist.

Preferably the front end has an opening adapted to a back projection of the piercer, and the opening changes into a hollow space, in which the twisting device provided with the blades and connected to the feed pipe so that when the piercer is removed from the opening, and the carrier gas, laden with the lubricant and/or descaling agent, flowing through the feed pipe goes out with a twist through the opening.

It is essential in the invention that the lubricant and/or descaling agent be applied to the inside wall of the hollow billet during the respective operation, i.e., during the movement of the hollow billet relative to the piercer rod, namely, preferably not on the wall surface to be processed during this operation but—suitably with the help of an inert carrier gas current—through outlets on the front end or on the part of the piercer rod adjacent to it on the hollow billet inside surface already processed by the piercer for its further processing in the next operation (second pass or smoothing).

The application during the operation provides an automatic uniform distribution of the agent over the hollow billet inside wall, the preferred application to the already processed inside surface, suitably with advancing of the hollow billet, by the part of the piercer rod adjacent to the piercer, on the respective immediately previously processed hollow billet surface with an inert gas, prevents calling from the start. The agent can be a pure lubricant but it can also additionally contain a descaling agent again to remove quickly a beginning scaling already at the formation. (The time between the processing in the first and the processing in the second pass would be too short for a complete descaling.)

BRIEF DESCRIPTION OF THE DRAWING

Embodiments of the invention are explained in greater detail below with the help of the drawing. In the drawing.

Figure 1:
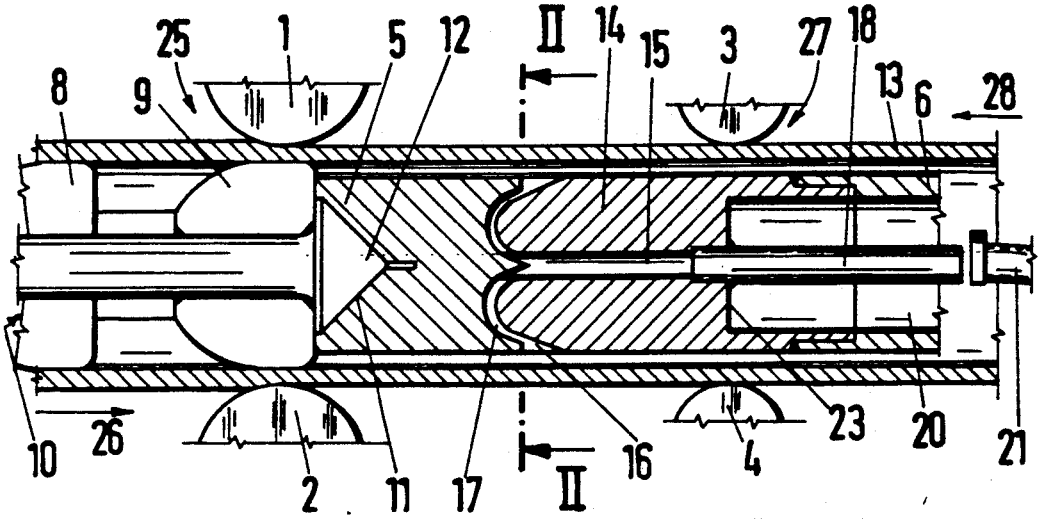
FIG. 1 is an axial longitudinal section through the piercer rod with the piercer of a piercing mill in the rolling a hollow billet.
Figure 2:
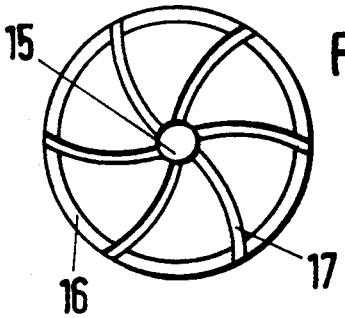
FIG. 2 is a section along line II—II of FIG. 1.

The piercing mill indicated diagrammatically in FIGS. 1 and 2 has a pair of working rolls 1,2 and a pair of retracting rolls 3,4. Piercer 10 consisting of guiding part 8 and working part 9 sits on front end 5 of piercer rod 6 supported against a support (not shown) behind the rolling mill. Front end 5 of the piercer rod, for detachable holding of piercer 10, has an opening 11, in which tapered rear projection 12 of piercer 10 sits. Roll pass 1,2 and piercer 10 form an annular clearance which corresponds to the wall thickness of hollow billet 13 desired in the first pass.

Several ducts 17 running from an axial bore 15 of piercer rod 6 to peripheral groove 16 of the rod jacket are provided in front part 14 of piercer rod 6 adjacent to front end 5. Ducts 17 communicate, by bore 15, with feed pipe 18 for a carrier gas (nitrogen) laden with a lubricant and descaling agent (hereafter abbreviated lubricant) screwed in the back end of bore 15 and welded to part 14 and run in a curved manner in peripheral groove 16 so that the carrier gas comes out backward (to the right in FIG. 1) with a twist through the groove. (For production engineering reasons from part 14 consists of two pieces welded together in whose adjacent sides ducts 16 are milled.)

Feed pipe 18 projects in hollow space 20 of piercer rod 6, which extends up to (not shown) to back end of the piercer rod and is open at the back. To feed pipe 18 is connected feed hose 21 which is run through hollow space 20 toward the back from rod 6 to a charging device (not shown) for charging the carrier current with the lubricant. (This device can be embodied according to the device described in co-pending, commonly-owned U.S. application Ser. No. 293,525, filed on Jan. 5, 1989, which does not belong to the prior art. The pertinent parts of U.S. Ser. No. 293,525 are incorporated herein by reference.) Further, in hollow space 20 is laid a cooling water pipe (not shown), which extends close to front end wall 23 of hollow space 20 and is run backward from the hollow space to a cooling water source (not shown). The cooling water flowing forward in operation from the cooling water pipe first cools wall 23 and thus front rod part 14 and in the back flow through hollow space 20 also entire remaining piercer rod 6, after which it flows out at the back (right in FIG. 1) from hollow space 20.

Hollow billet 13, pierced by a piercing mandrel in a rotary piercing mill, is descaled, before processing by the rolling mill represented in FIG. 1, for example by the device described in European Published Patent Application No. 250,881, and descaling agent acting simultaneously as lubricant or a descaling agent, to which a lubricant is added, is introduced into the hollow billet. After the end of the time necessary for descaling, hollow billet 13 is rolled out in a first pass of the rolling mill represented in FIG. 1. Here, hollow billet 13, by means of the pair of working rolls 1, 2 rotating in direction of rotation 25, is advanced in the direction of arrow 26 over piercer 10 on front end 5 of piercer rod 6.

During the entire advance 26 of hollow billet 13, a nitrogen current, laden by a charging device (not shown) with a lubricant (lubricant powder or lubricant granulate optionally with additives), is carried by feed pipe 21,18,15 and ducts 16 with backward twist (in FIG. 1 to the right) onto the inside wall of hollow billet 13. Thus, the nitrogen current laden with the lubricant flows out behind piercer 10 with a twist (backward), and the lubricant uniformly distributed on the hollow billet inside wall processed immediately before by the piercer is deposited. Thus, the lubricant applied in the first pass on the inside wall of the hollow billet serves not for lubricating in this but only in the next (second) pass. Lubrication in the first pass is ensured by the descaling agent, applied before the first pass by means of the device described in acting simultaneously as lubricant or provided with an admixture of lubricant.

So that the lubricant will not go out toward the back from the hollow billet at the beginning of the advance the beginning of the lubricant feed can be controlled by the charging device so that the lubricant goes out of duct 17 only after piercer 10 has already covered a certain travel. At the end of the advance, the lubricant feed is adjusted but the nitrogen flow through feed pipes 21,18,15 and duct 16 continues (constantly) to be maintained.

After hollow billet 13 is completely advanced over piercer 10 and the latter is removed, the hollow billet is brought back in the direction of arrow 28 by means of the pair of return rolls 3,4 rotating in the direction of rotation 27. At the same time, nitrogen continues to be blown constantly through feed pipe 21,18,15 and duct 16. (The nitrogen flow can be reduced if no lubricant is fed.)

At the end of the advance and at the end of the return cooling water, which flows over working rolls 1,2, can be sprayed on front part 14 of piercer rod 6. Since nitrogen constantly goes out through ducts 16 it cannot penetrate into them, so that the danger of blocking of the ducts as a result of mixing of the lubricant with the water is avoided.

Now the second pass follows, for which a piercer 10 with a greater diameter is put on piercer rod 6. (The nitrogen flow is maintained even during mounting of the piercer.) Just as in the first pass, hollow billet 13 in the second pass 16 advanced and again, brought back over piercer 10 of greater diameter. For this second pass, the lubricant was applied during the first pass. Also in the advance of the second pass, the lubricant is applied on the hollow billet inside wall processed by piercer 10. This application takes place for the third operation, in which the inside wall of the hollow billet is smoothed in a reeling mill (not shown).

Figure 4:
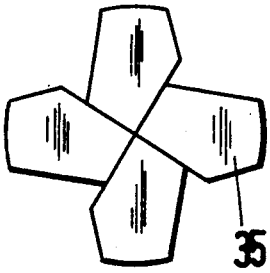
FIG. 4 is a section along line IV—IV in FIG. 3.
Figure 3:
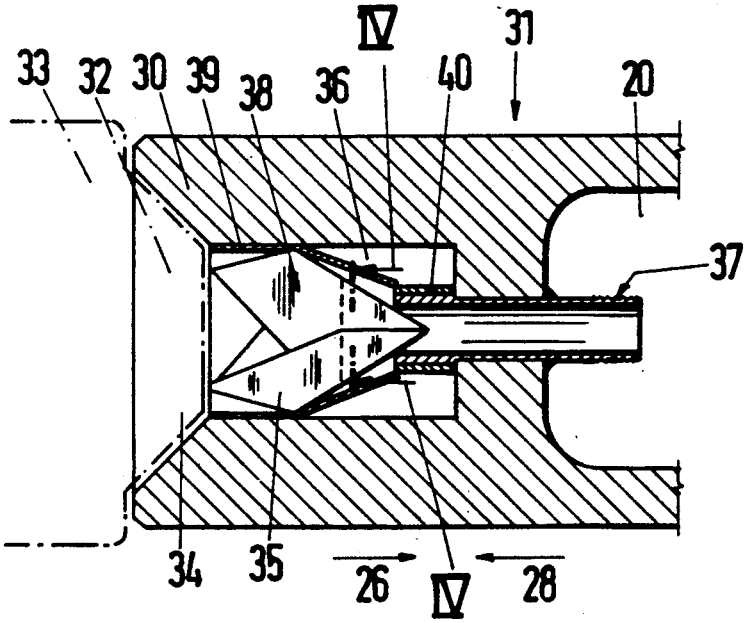
FIG. 3 is an axial longitudinal section through a variant of the piercer rod of FIG. 1.

In the variant represented in FIGS. 3 and 4, front end 30 of piercer rod 31 also has an opening 34 adapted to a rear projection 32 of piercer 33. Opening 34 changes into a hollow space 36 in the front rod part, in which a twisting device 38 provided, e.g., with four blades 35 is placed and connected to a feed pipe 37 for the lubricant. Blades 35 are surrounded by a funnel 39 whose neck 40 sits on feed pipe 37. The blade arrangement is made so that the carrier gas, laden with the lubricant, flowing through feed pipe 37 with piercer 33 removed from opening 34, goes out with a twist through funnel 39 and opening 34. A feed hose, run through hollow space 20 of rod 31 to the charging device, is connected to feed pipe 37 as in the embodiment of FIG. 1.

In contrast with the embodiment of FIGS. 1 and 2, in the variant of FIGS. 3 and 4 the lubricant is not applied in advance of the hollow billet (not represented in FIG. 3) but only during its return 28, after removal of piercer 33. At first only nitrogen is carried through feed pipe 37 by means of the charging device. The lubricant feed is so controlled by the charging device that the lubricant goes out of twisting device 38 only after the hollow billet, by means of the return rolls, has covered a part of the return travel which is so great the lubricant of the carrier gas current coming out with a twist is deposited (almost) completely on the inside wall of the hollow billet and at most a negligibly small portion of the lubricant comes out from the end of the hollow billet. Up to the end of the return travel the lubricant continues to be carried out through twisting device 38 by means of the carrier gas current, so that the entire inside wall of the hollow billet is uniformly covered with the lubricant.

Also the lubricant applied with the variant of FIGS. 3 and 4 in the first pass is used to lubricate the piercer in the second pass. In the second pass, in correspondence with the first pass, during the return of the hollow billet lubricant continues to be applied through twisting device 38 on the inside wall of the hollow billet, processed by piercer 33 during advance 26, for smoothing in a third operation.

The embodiment represented in FIGS. 1 and 2 has the advantage, in comparison with that in FIGS. 3 and 4, that the lubricant is applied immediately after processing of the inside wall, so that from the beginning a scaling cannot occur in practice and the lubricant also acting as descaling agent or containing a descaling agent can work over a prolonged period. The embodiment represented in FIGS. 3 and 4, in comparison with the embodiment in FIGS. 1 and 2, has the advantage in design that no lateral bores in the piercer rod are necessary, so that, from a production engineering viewpoint, it can be achieved in a simpler and stabler way.

In the embodiment represented in FIG. 1, as mentioned, the outlet ends of ducts 17 are directed toward the back (on the right in FIG. 1). Consequently the carrier gas current laden with the lubricant comes out toward the back with a twist (on the right in FIG. 1). This is suitable if ducts 17 are placed close to front end 5, since otherwise the twist of the outgoing driving gas during advance 26 on piercer 9 can be broken and thus the uniformity of the lubricant distribution can be impaired and in addition the lubricant at the falling out of piercer 10 at the end of advance 26 from the hollow billet end can occur with environmental pollution, if the lubricant feed is not interrupted exactly at the correct time. Ducts 17 can run in a radial plane (curved), but a uniform distribution can be achieved only with very many ducts, or the ducts can run forward (in the direction of hollow 28) into peripheral groove 16. In the latter case, they are suitably placed somewhat farther back in case of correspondingly longer dimensioned part 14, and piercer 10 in any case, during the advance, prevents lubricant from going out of the hollow billet at the front.

With the embodiment represented in FIGS. 1 and 2, lubricant basically could be applied on the inside wall both during advance 26 and return 28 of the hollow billet. But a double delivery is not necessary and only unnecessarily consumed much lubricant.

As mentioned, the lubricant to be applied to the hollow billet wall can be composed so that it simultaneously acts, as it were, as prophylactic descaling agent, i.e., already at the origin prevents scaling, and depending on the hollow billet material and the kind of processing (second pass or smoothing), for which it is applied, can be provided with suitable additives. As already mentioned, the lubricant preferably is applied with an inert carrier gas current, especially nitrogen, and the inert carrier gas current (also without charging with the lubricant) is maintained constant, optionally reduced, so that scaling can largely be prevented at the beginning. Especially by use of sufficient inert gas a pure lubricant can therefore also be used.

Attention is drawn to co-pending, commonly-owned U.S. application Ser. No. 243,703, filed on Sept. 13, 1988.

What is claimed is:

1. A process for making hollow billets (13) into tubes, comprising:

(a) applying a lubricant on the inside wall of the hollow billet (13);

(b) advancing the hollow billet (13) over a first piercer (10) which has been placed on the front end (5) of a piercer rod (6), and while the hollow billet (13) is advanced relative to said first piercer (10); applying a lubricant behind said first piercer (10)

on that part of the inside wall of the hollow billet (13) which has already been processed by the first piercer (10);

(c) removing said first piercer (10) from said piercer rod (6);

(d) returning the hollow billet (13) to the position relative to said piercer rod (6) which it had at the beginning of step (b); and (e) placing a second piercer on said piercer rod (6), said second piercer having a greater diameter than said first piercer (10) and thereafter advancing said hollow billet (13) over said second piercer.

2. Process according to claim 1 wherein as said hollow billet (13) is advanced over said first piercer (10), an inert gas is directed inside of the hollow billet (13) to prevent scaling of the inside wall of the hollow billet (13).

3. Process according to claim 2 wherein the lubricant or descaling agent is directed onto the inside wall of the hollow billet (13) by means of a carrier gas current emminating from the front end (5, 30) or a part (14) of said piercer rod (6, 31) adjacent to the front end of said piercer rod (6, 31).

4. Process according to claim 3 wherein the carrier gas current is an inert gas carrier.

5. Process according to claim 3 wherein said carrier gas current, laden with the lubricant or descaling agent, is advanced through said piercer rod (6, 31) and emitted through one or more outlet openings (16, 17, 34) placed on the front end (5, 30) of said piercer rod (6, 31) or from a part (14) of said piercer rod (6, 31) connected to the front end (5, 20), and is thereafter directed towards the inside wall of the hollow billet (13).

6. Process according to claim 5 wherein said inert gas, used as the carrier gas for the lubricant or descaling agent, is continuously directed, unladen, through said piercer rod (6, 31) and said outlet openings (16, 17, 34) to prevent both a scaling of the inside wall of the hollow billet (13) and to prevent a penetration of cooling water into said outlet openings (16, 17, 34).

7. Process according to claim 6 wherein the inert gas is nitrogen.

8. Process according to claim 5 wherein a twist is imparted to said carrier gas current laden with said lubricant or descaling agent, as it leaves said openings (16, 17, 34).

9. Process according to claim 8 wherein said lubricant or descaling agent is applied to the inside wall of the hollow billet (13) behind said piercer (10) during each advance of the hollow billet (13).

10. Process according to claim 9 wherein said carrier gas current laden with said lubricant or descaling agent is directed away from said piercer (10) and is directed with a twist onto the inside wall of the hollow billet (13).

11. Process according to claim 9 wherein the lubricant or descaling agent is applied to the inside wall of the hollow billet (13) through said front end (30) of said piercer rod (6, 31) or through said part (14) of said piercer rod (6, 31) connected to said front end (30) each time the hollow billet (13) is returned to its initial position.

12. Process according to claim 11 further comprising the step of: (f) smoothing the hollow billet (13); wherein, before step (f), a lubricant or descaling agent is applied on the inside wall of the hollow billet (13) to facilitate said smoothing.

13. Process according to claim 1 wherein at least during step (b), an inert gas is directed inside of the hollow billet (13) to prevent scaling of the inside wall of said hollow billet (13).

14. Process according to claim 1 wherein the lubricant or descaling agent is directed onto the inside wall of said hollow billet (13) by means of a carrier gas current emitted from the front end (5, 30) of said piercer rod (6, 31) or from a part (14) of said piercer rod (6, 31) connected to the front end of said piercer rod (6, 31).

15. Process according to claim 14 wherein the carrier gas current is an inert gas current.

16. Process according to claim 1 wherein the lubricant or descaling agent is applied to the inside wall of the hollow billet (13), behind said first piercer (10), during each advance of the hollow billet (13).

17. Process according to claim 1 wherein said lubricant or descaling agent is applied to the inside wall of the hollow billet (13) through the front end (30) or through said part (14) of said piercer rod (6, 31) connected to said front end (30) each time the hollow billet (13) returns to its initial position relative to said first piercer (10).

18. Process according to claim 1 further comprising the step of: (f) smoothing the hollow billet (13), wherein, before step (f), a lubricant or descaling agent is applied on the inside wall of the hollow billet (13) to facilitate said smoothing.

19. The process according to claim 1 wherein said lubricant also includes a descaling agent.

20. A process for making hollow billets (13) into tubes, comprising:

(a) applying a lubricant on the inside wall of the hollow billet (13);

(b) advancing the hollow billet (13) over a first piercer (33) which has been placed on the front end (30) of a piercer rod (31);

(c) removing said first piercer (33) from said piercer rod (31);

(d) returning the hollow billet (13) to the position relative to said piercer rod (6) which it had at the beginning of step (b) and simultaneously applying a lubricant through said piercer rod (31) onto the inside wall of the hollow billet (13) being process by the first piercer (33); and (e) placing a second piercer on said piercer rod (6), said second piercer having a greater diameter than said first piercer (33).

21. The process according to claim 20 wherein said lubricant also includes a descaling agent.

* * * * *